US007591290B2

(12) United States Patent
Bourgeois et al.

(10) Patent No.: US 7,591,290 B2
(45) Date of Patent: Sep. 22, 2009

(54) PROTECTION OF CRYOGENIC STORAGE UNITS AGAINST FILLING OVERPRESSURES

(75) Inventors: Emmanuel Bourgeois, Longjumeau (FR); André Marion, Villeparisis (FR); Robert Wallez, Ayrens (FR); Jean-Marc Rozo, Ormesson (FR)

(73) Assignee: L'Air Liquide, Societe Anonyme a Directoire et Conseil de Surveillance pour l'Etude et l'Exploitation des Procedes Georges Claude, Paris (FR)

( * ) Notice: Subject to any disclaimer, the term of this patent is extended or adjusted under 35 U.S.C. 154(b) by 214 days.

(21) Appl. No.: 10/562,982

(22) PCT Filed: Jun. 23, 2004

(86) PCT No.: PCT/FR2004/050287

§ 371 (c)(1),
(2), (4) Date: Dec. 28, 2005

(87) PCT Pub. No.: WO2005/008121

PCT Pub. Date: Jan. 27, 2005

(65) Prior Publication Data

US 2006/0130925 A1 Jun. 22, 2006

(30) Foreign Application Priority Data

Jul. 10, 2003 (FR) ..... 03 50317

(51) Int. Cl.
*B65B 1/30* (2006.01)

(52) U.S. Cl. ..... 141/83; 141/231

(58) Field of Classification Search ..... 141/231, 141/59, 82, 83, 94; 137/899; 222/608
See application file for complete search history.

(56) References Cited

U.S. PATENT DOCUMENTS 4,657,055 A * 4/1987 Poulsen ..... 141/83

(Continued)

FOREIGN PATENT DOCUMENTS

EP 0527045 2/1993

(Continued)

OTHER PUBLICATIONS

International Search Report for PCT/FR2004/050287.

(Continued)

*Primary Examiner*—Timothy L Maust
*Assistant Examiner*—Jason K Niesz
(74) *Attorney, Agent, or Firm*—Christopher J. Cronin; Patricia E. McQueeney

(57) ABSTRACT

Safe filling is provided by a housing (8) controlling the pump (6) of the mobile tank (1) receiving, via a secondary hose (10), the pressure prevailing in the container (2) to be filled, a programmable logic enabling the pump to operate when the pressure measured in the container is within a predetermined range, adaptable according to the type of container. The invention is applicable in particular to gas containers.

7 Claims, 1 Drawing Sheet

U.S. PATENT DOCUMENTS

| | | | | | |
|---|---|---|---|---|---|
| 4,805,672 | A | * | 2/1989 | Berrettini et al. | 141/5 |
| 5,062,417 | A | * | 11/1991 | Cowen | 600/40 |
| 5,238,030 | A | * | 8/1993 | Miller et al. | 141/4 |
| 5,373,702 | A | * | 12/1994 | Kalet et al. | 62/50.2 |
| 5,551,490 | A | | 9/1996 | Kountz et al. | 62/50.1 |
| 5,771,946 | A | * | 6/1998 | Kooy et al. | 141/82 |
| 5,954,101 | A | * | 9/1999 | Drube et al. | 141/82 |
| 6,216,719 | B1 | * | 4/2001 | Meyer | 137/68.14 |
| 6,314,981 | B1 | | 11/2001 | Mayzou et al. | 141/82 |
| 6,354,088 | B1 | | 3/2002 | Emmer et al. | |

FOREIGN PATENT DOCUMENTS

| | | |
|---|---|---|
| EP | 0 999 402 | 5/2000 |
| EP | 1 291 575 | 3/2003 |

OTHER PUBLICATIONS

Compressed Gas Association, "CGA Regulatory Alert (RA-77) Mobile Acetylene Trailers Press Release and Special Investigation Report," Mar. 10, 2009, 1 pg.

NTSB News, "NTSB Calls for Improved Safety Measures for Mobile Acetylene Trailers," Press Release Mar. 5, 2009, 1 pg.

National Transportation Safety Board, "Mobile Acetylene Trailer Accidents: Fire During Unloading in Dallas, Texas, Jul. 25, 2007; Fire During Unloading in The Woodlands, Texas, Aug. 7, 2007; and Overturn and Fire in East New Orleans, Louisiana, Oct. 20, 2007," Special Investigation Report, NTSB/SIR-09/01, PB2009-917002, 37 pgs.

* cited by examiner

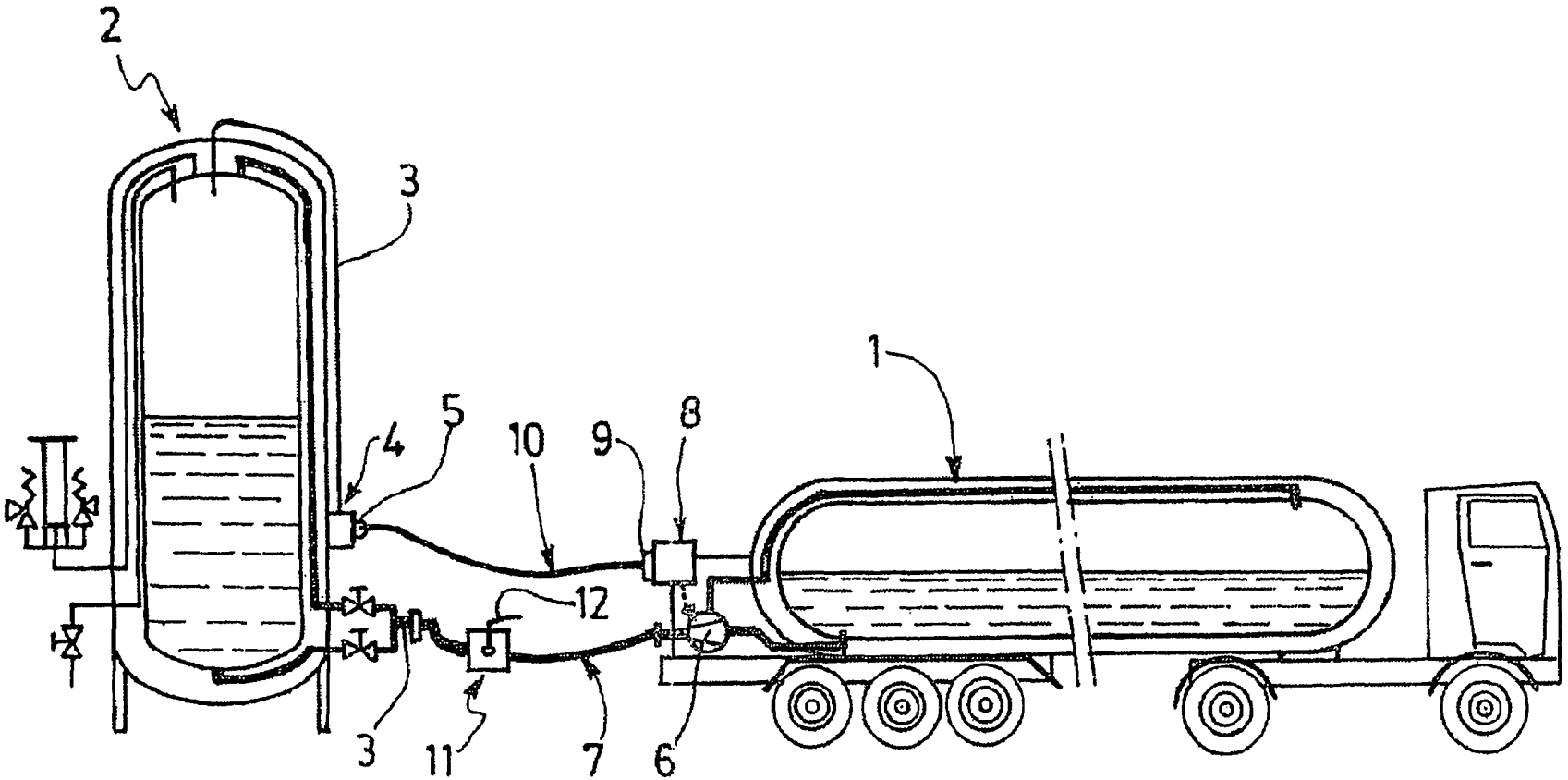
1
2
3
4
5
6
7
8
9
10
11
12
3

PROTECTION OF CRYOGENIC STORAGE UNITS AGAINST FILLING OVERPRESSURES

The present invention relates to systems for filling a cryogenic fluid storage tank from a mobile tank comprising a pressurized-fluid supply pump that can be connected via a filling hose to a fluid inlet of the storage tank.

The use of a pressurized-fluid filling pump means that safety precautions have to be taken in order to avoid creating overpressures in the storage tank when filling it. To do this, it is proposed that the pump delivery be restricted using a calibrated orifice and/or that a pneumatic or electromagnetic valve sensitive to a pressure signal representing the pressure in the storage tank be associated with the fluid inlet of the storage tank.

It is an object of the present invention to propose a filling system with enhanced safety and lower maintenance costs.

To do this, according to one characteristic of the invention, the mobile tank comprises a pump control unit including a pressure sensor that can be connected to a pressure tapping of the storage tank, and programmable logic allowing the pump to operate when the pressure measured in the storage tank lies within a predetermined range.

According to other characteristics of the invention:

- the control unit is connected to a secondary hose that can be connected selectively to the pressure tapping of the storage tank,
- the cryogenic fluid is a gas from the air,
- the filling hose comprises a disengageable non-return valve device.

With the system according to the invention, the safety measures are transferred onto the supplier of liquid, thus dispensing with the problems of vigilance and maintenance at the site of the storage tank.

In addition, since the safety system is now associated not with the storage tanks but with the mobile tank, which supplies numerous storage tanks, the overall installation and operating costs are vastly reduced.

The present invention will now be described in conjunction with one particular embodiment given by way of non-limiting illustration and with reference to the attached drawing which, schematically, shows a storage tank filling system according to the invention.

The single FIGURE shows a mobile tank 1, here consisting of a road semitrailer, and a stationary cryogenic-fluid storage tank 2 comprising, in the conventional way, a filling inlet 3 intended to be connected to the mobile tank.

The storage tank 2 further comprises a pressure tapping line 3 ending in a unit 4 comprising an outlet coupling 5.

According to one aspect of the invention, the mobile tank 1 comprises a pump 6 for carrying the cryogenic fluid contained in the tank under pressure to the inlet 3 of the storage tank 2 via a filling hose 7. The tank 1 also comprises a pump control unit 8 operationally connected to the pump and comprising a pressure measurement inlet 9 that can be connected, via a dedicated secondary hose 10, to the outlet 5 of the unit 4.

According to the invention, the pump control unit 8 includes a pressure sensor measuring the pressure transmitted by the fluid 10 and supplying a pressure signal that is compared, in programmable logic, with a predetermined range of pressures within which operation of the pump 6 is permitted. With this arrangement, when the hoses 7 and 10 are in place, the pressure sensor of the control unit 8 measures the pressure obtaining prior to refilling in the storage tank 2, the programmable controller establishing the predetermined operating range according to the pressure level detected in the storage tank.

In practice, cryogenic containers are split into three main pressure range categories which thus define the pump operating ranges: typically from 0.5 to 5 bar; from 6 to 15 bar; or from 16 to 35 bar. Depending on the operating range thus adopted, the programmable controller of the unit 8 allows the pump 6 to start up with a delivery pressure corresponding to the minimum pressure of the range then triggers a safety shutdown of the pump if the maximum pressure of the preprogrammed range is reached in the storage tank.

The system according to the invention therefore affords positive safety, namely it guarantees that it will be impossible to start the pump if the system fails. In addition, the secondary hose cannot be kept under pressure when disconnected from the storage tank, which means that the pressure seen by the pressure sensor is then brought down to a value of 0 bar gauge, again preventing any pump start-up.

In one particular embodiment, the hose 7 is also provided with a disconnectable non-return valve device 11 which normally, when in the set position, allows the fluid to flow only in the direction from the pump 6 to the fluid inlet 3. Through a manual mechanical device depicted schematically in the form of the lever 12, the valve can be placed in an inactive position allowing fluid to flow in the opposite direction, thus making it possible to manually bleed part of the pipeline, the hose 7 then of course being disconnected from the pump 6.

Through an internal automatic mechanical device, a flow of the fluid in the normally permitted direction returns the non-return valve device 11 to its operational state ready for normal operation.

Although the invention has been described in conjunction with some particular embodiments, it is not restricted thereto but can be modified and varied in ways that will be evident to the person skilled in the art within the scope of the claims that follow.

In particular, to improve safety and optimize storage-tank filling rounds using the mobile tank 1, the storage tanks 2 are advantageously equipped with a vaporizer device which pressurizes them sufficiently in order to allow them to satisfy the delivery and pressure demanded by the user until they are completely empty. In addition, the storage tank 2 advantageously comprises telemetry remotely assessing the level and associated with a calculation that calculates the remaining capability so that the next delivery of fluid can be scheduled to occur when there is the lowest possible reserve left in the storage tank, compatible with guaranteed continuity of supply to the user.

The invention claimed is:

1. A system for filling a cryogenic fluid storage tank from a mobile tank comprising a pressurized-fluid supply pump connectable via a filling hose to a fluid inlet of the storage tank, wherein the mobile tank comprises a pump control unit including a pressure sensor connectable to a pressure tapping of the storage tank via a secondary hose, said pressure sensor adapted to measure a pressure inside the storage tank and supply the measured pressure to a programmable controller, said programmable controller being written with programmable logic allowing the pump to operate only when the pressure measured in the storage tank lies within one of three pressure ranges, said programmable logic adapted to:

i) compare the measured pressure to the three pressure ranges, each one of which has a minimum pressure and a maximum pressure, ii) establish operation of the pump within one of said pressure ranges, and iii) trigger a safety shutdown of the pump if the maximum pressure of the established range is reached within the storage tank.

2. The system of claim 1, wherein the control unit is connected to a secondary hose that can be connected selectively to the pressure tapping of the storage tank.

3. The system of claim 1, wherein the filling hose comprises a manually-disengageable non-return valve device.

4. The system of claim 1, wherein the cryogenic fluid is a gas from the air.

5. The system of claim 1, wherein a first pressure ranges is from 0.5 to 5 bar, a second pressure ranges is from 6 to 15 bar, and a third pressure ranges is from 16 to 35 bar.

6. The system of claim 1, wherein said programmable logic allows the pump to start up with a delivery pressure corresponding to a lower limit of said range and triggers a safety shutdown of said pump if the upper limit of said range is reached in said storage tank.

7. The system of claim 1, wherein said secondary hose is adapted such that said secondary hose cannot be kept under pressure when disconnected from the pressure tapping.

* * * * *

UNITED STATES PATENT AND TRADEMARK OFFICE

CERTIFICATE OF CORRECTION

PATENT NO. : 7,591,290 B2
APPLICATION NO. : 10/562982
DATED : September 22, 2009
INVENTOR(S) : E. Bourgeois et al.

It is certified that error appears in the above-identified patent and that said Letters Patent is hereby corrected as shown below:

In Column 4, line 3, replace the word "ranges" with the word --range--.

In Column 4, line 4, replace the word "ranges" with the word --range--.

In Column 4, line 5, replace the word "ranges" with the word --range--.

Signed and Sealed this

Thirtieth Day of March, 2010

David J. Kappos

David J. Kappos
*Director of the United States Patent and Trademark Office*